US011174851B2

(12) United States Patent
Iwanaji

(10) Patent No.: US 11,174,851 B2
(45) Date of Patent: Nov. 16, 2021

(54) HYDRAULIC ROTATING MACHINE

(71) Applicant: KYB Corporation, Tokyo (JP)

(72) Inventor: Tetsuya Iwanaji, Kanagawa (JP)

(73) Assignee: KYB CORPORATION, Tokyo (JP)

( * ) Notice: Subject to any disclaimer, the term of this patent is extended or adjusted under 35 U.S.C. 154(b) by 0 days.

(21) Appl. No.: 16/760,304

(22) PCT Filed: Sep. 5, 2019

(86) PCT No.: PCT/JP2019/034985

§ 371 (c)(1),
(2) Date: Apr. 29, 2020

(87) PCT Pub. No.: WO2020/066526

PCT Pub. Date: Apr. 2, 2020

(65) Prior Publication Data

US 2020/0340360 A1 Oct. 29, 2020

(30) Foreign Application Priority Data

Sep. 28, 2018 (JP) ..... JP2018-183678

(51) Int. Cl.

| | |
|---|---|
| ***F04B 1/324*** | (2020.01) |
| ***F04B 1/32*** | (2020.01)*F01B 3/00* |
| (2006.01) | *F04B 49/08* |
| (2006.01) | *F03C 1/40* |
| (2006.01) | |

(52) U.S. Cl.

CPC ..... *F04B 1/324* (2013.01); *F04B 1/32* (2013.01); *F01B 3/007* (2013.01); *F03C 1/0686* (2013.01); *F04B 49/08* (2013.01)

(58) Field of Classification Search

CPC ..... F04B 1/324; F04B 1/22; F04B 49/002; F04B 49/08; F01B 3/007

See application file for complete search history.

(56) References Cited

U.S. PATENT DOCUMENTS 3,250,227 A * 5/1966 Kouns ..... F01B 3/106 91/473

FOREIGN PATENT DOCUMENTS

DE 102011117543 A1 * 5/2013 ..... F04B 1/2078
JP 2008-240518 A 10/2008

OTHER PUBLICATIONS

DE 102011117543 A1 machine translation to English from espacenet (Year: 2013).*

* cited by examiner

*Primary Examiner* — Thomas E Lazo
*Assistant Examiner* — Michael Quandt
(74) *Attorney, Agent, or Firm* — Rabin & Berdo, P.C.

(57) ABSTRACT

A piston pump includes a first biasing mechanism configured to bias a swash plate in accordance with supplied control pressure, a second biasing mechanism configured to bias the swash plate against the first biasing mechanism, and a regulator configured to control the control pressure led to the first biasing mechanism in accordance with discharge pressure of the piston pump, wherein the second biasing mechanism has a pressure chamber to which the discharge pressure is led, and a control piston configured to be biased toward the swash plate by the discharge pressure led to the pressure chamber, and the regulator has a biasing member configured to bias the control piston toward the swash plate, and a control spool configured to be moved in accordance with biasing force of the biasing member, the control spool being configured to adjust fluid pressure.

4 Claims, 3 Drawing Sheets

HYDRAULIC ROTATING MACHINE

TECHNICAL FIELD

The present invention relates to a hydraulic rotating machine.

BACKGROUND ART

JP2008-240518A discloses a swash plate type piston pump including a horsepower control regulator configured to control discharge pressure and a discharge flow rate by a fixed horsepower characteristic with which outputs are substantially fixed. This swash plate type piston pump includes a small diameter piston configured to drive in the direction in which a tilting angle is increased and a large diameter piston configured to drive a swash plate in the direction in which the tiling angle is decreased as tilting actuators configured to change the tilting angle of the swash plate. The horsepower control regulator includes outside and inside control springs configured to push a feedback pin to be displaced following the swash plate to the swash plate side, a control spool configured to control hydraulic pressure led to a pressure chamber of the large diameter piston, and a stepped shaft portion.

SUMMARY OF INVENTION

In the piston pump of JP2008-240518A, the tilting angle of the swash plate is controlled by the small diameter piston and the large diameter piston serving as the tilting actuators, and the horsepower control regulator detects the tilting angle of the swash plate by the feedback pin and perform horsepower control. In such a piston pump, there is a need for ensuring installment spaces for the small diameter piston, the large diameter piston, and the feedback pin of the horsepower control regulator, respectively. Thus, size of the device is increased.

An object of the present invention is to downsize a hydraulic rotating machine.

According to one aspect of the present invention, a hydraulic rotating machine includes a cylinder block configured to be rotated following rotation of a drive shaft, plural cylinders formed in the cylinder block and arranged at predetermined intervals in the circumferential direction of the drive shaft, pistons slidably inserted into the cylinders and configured to partition capacity chambers inside the cylinders, a swash plate configured to let the pistons reciprocate so that the capacity chambers are expanded and contracted following rotation of the cylinder block, a first biasing mechanism configured to bias the swash plate in accordance with supplied control pressure, a second biasing mechanism configured to bias the swash plate against the first biasing mechanism, and a regulator configured to control the control pressure led to the first biasing mechanism in accordance with self-pressure of the hydraulic rotating machine, wherein the second biasing mechanism has a pressure chamber to which the self-pressure is led; and a control piston configured to be biased toward the swash plate by the self-pressure led to the pressure chamber, and the regulator has a biasing member configured to bias the control piston toward the swash plate, and a control spool configured to be moved in accordance with biasing force of the biasing member, the control spool being configured to adjust the control pressure.

DESCRIPTION OF EMBODIMENTS

Hereinafter, with reference to the drawings, a hydraulic rotating machine 100 according to an embodiment of the present invention will be described.

The hydraulic rotating machine 100 functions as a piston pump capable of supplying working oil serving as a working fluid by rotating a shaft (drive shaft) 1 by power from the outside and letting pistons 5 reciprocate, and also functions as a piston motor capable of outputting rotation drive force by letting the pistons 5 reciprocate and rotating the shaft 1 by fluid pressure of the working oil supplied from the outside. The hydraulic rotating machine 100 may only function as the piston pump or may only function as the piston motor.

In the following description, a case where the hydraulic rotating machine 100 is used as the piston pump will be shown as an example, and the hydraulic rotating machine 100 will also be called as the "piston pump 100".

Figure 1:
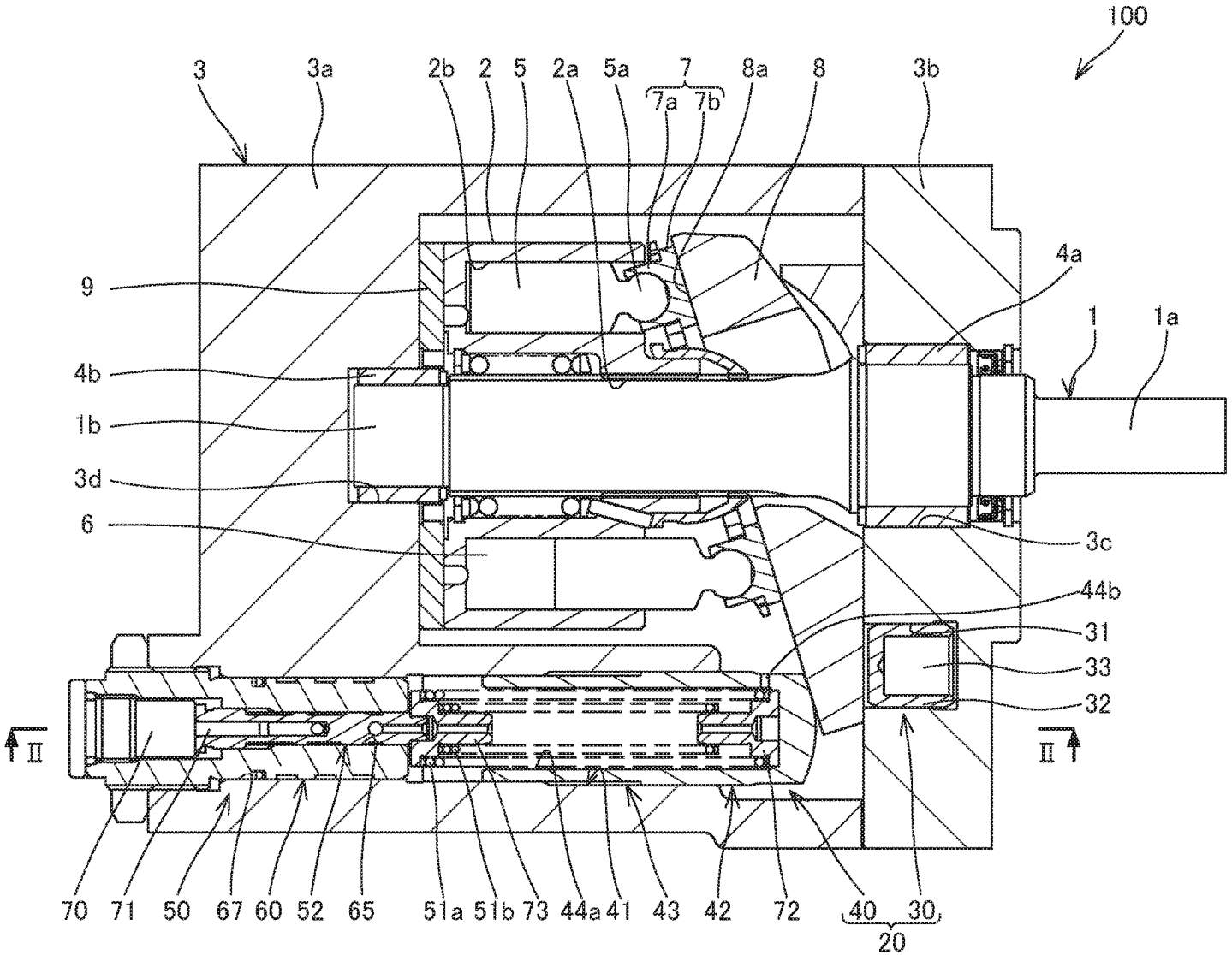
FIG. 1 is a sectional view of a hydraulic rotating machine according to an embodiment of the present invention.

The piston pump 100 is used, for example, as an oil pressure source configured to supply the working oil to an actuator (not shown) such as a hydraulic cylinder that drives an object to be driven. As shown in FIG. 1, the piston pump 100 includes the shaft 1 configured to be rotated by a power source, a cylinder block 2 coupled to the shaft 1 and configured to be rotated together with the shaft 1, and a case 3 in which the cylinder block 2 is accommodated.

The case 3 includes a tubular and bottomed case main body (housing) 3*a*, and a cover 3*b* sealing an opening end of the case main body 3*a*, the cover through which the shaft 1 is inserted. The inside of the case 3 communicates with a tank (not shown) through a drain passage (not shown). The inside of the case 3 may communicate with a suction passage (not shown) to be described later.

The power source (not shown) such as an engine is coupled to one end portion 1*a* of the shaft 1 projecting to the outside through an insertion hole 3*c* of the cover 3*b*. The end portion 1*a* of the shaft 1 is rotatably supported by the insertion hole 3*c* of the cover 3*b* via a bearing 4*a*. The other end portion 1*b* of the shaft 1 is accommodated in a shaft accommodation hole 3*d* provided in a bottom portion of the case main body 3*a*, and rotatably supported via a bearing 4*b*. A rotation shaft (not shown) of another hydraulic pump (not shown) such as a gear pump configured to be driven by the power source together with the piston pump 100 is coaxially coupled to the other end portion 1*b* of the shaft 1 so that the rotation shaft is rotated together with the shaft 1.

The cylinder block 2 has a through hole 2*a* through which the shaft 1 passes, and splined to the shaft 1 via the through hole 2*a*. Thereby, the cylinder block 2 is rotated following rotation of the shaft 1.

Plural cylinders 2*b* each having an opening portion on one end surface are formed in the cylinder block 2 in parallel to the shaft 1. The plural cylinders 2*b* are formed at predetermined intervals in the circumferential direction of the cylinder block 2. Each of the columnar pistons 5 partitioning capacity chambers 6 is inserted into each of the cylinders 2*b* so that the piston 5 is reciprocable. The leading end side of the piston 5 projects from the opening portion of the cylinder 2*b*, and a spherical surface seat 5*a* is formed in a leading end portion of the piston 5.

The piston pump 100 further includes shoes 7 rotatably coupled to the spherical surface seats 5*a* of the pistons 5 and configured to be brought into sliding contact with the spherical surface seats 5*a*, a swash plate 8 configured to be brought into sliding contact with the shoes 7 following rotation of the cylinder block 2, and a valve plate 9 provided between the cylinder block 2 and the bottom portion of the case main body 3*a*.

Each of the shoes 7 includes a receiving portion 7*a* configured to receive the spherical surface seat 5*a* formed in a leading end of the piston 5, and a circular flat plate portion 7*b* configured to be brought into sliding contact with a sliding contact surface 8*a* of the swash plate 8. An inner surface of the receiving portion 7*a* is formed in a spherical surface shape and brought into sliding contact with an outer surface of the received spherical surface seat 5*a*. Thereby, the shoe 7 is capable of angular displacement in any directions with respect to the spherical surface seat 5*a*.

The swash plate 8 is tiltably supported by the cover 3*b* so that a discharge amount of the piston pump 100 is variable. The flat plate portion 7*b* of the shoe 7 is brought into surface contact with the sliding contact surface 8*a*.

The valve plate 9 is a circular plate member with which a base end surface of the cylinder block 2 is brought into sliding contact, and fixed to the bottom portion of the case main body 3*a*. Although not shown in the figures, a suction port connecting the suction passage formed in the cylinder block 2 and the capacity chambers 6 and a discharge port connecting a discharge passage formed in the cylinder block 2 and the capacity chambers 6 are formed in the valve plate 9.

Figure 2:
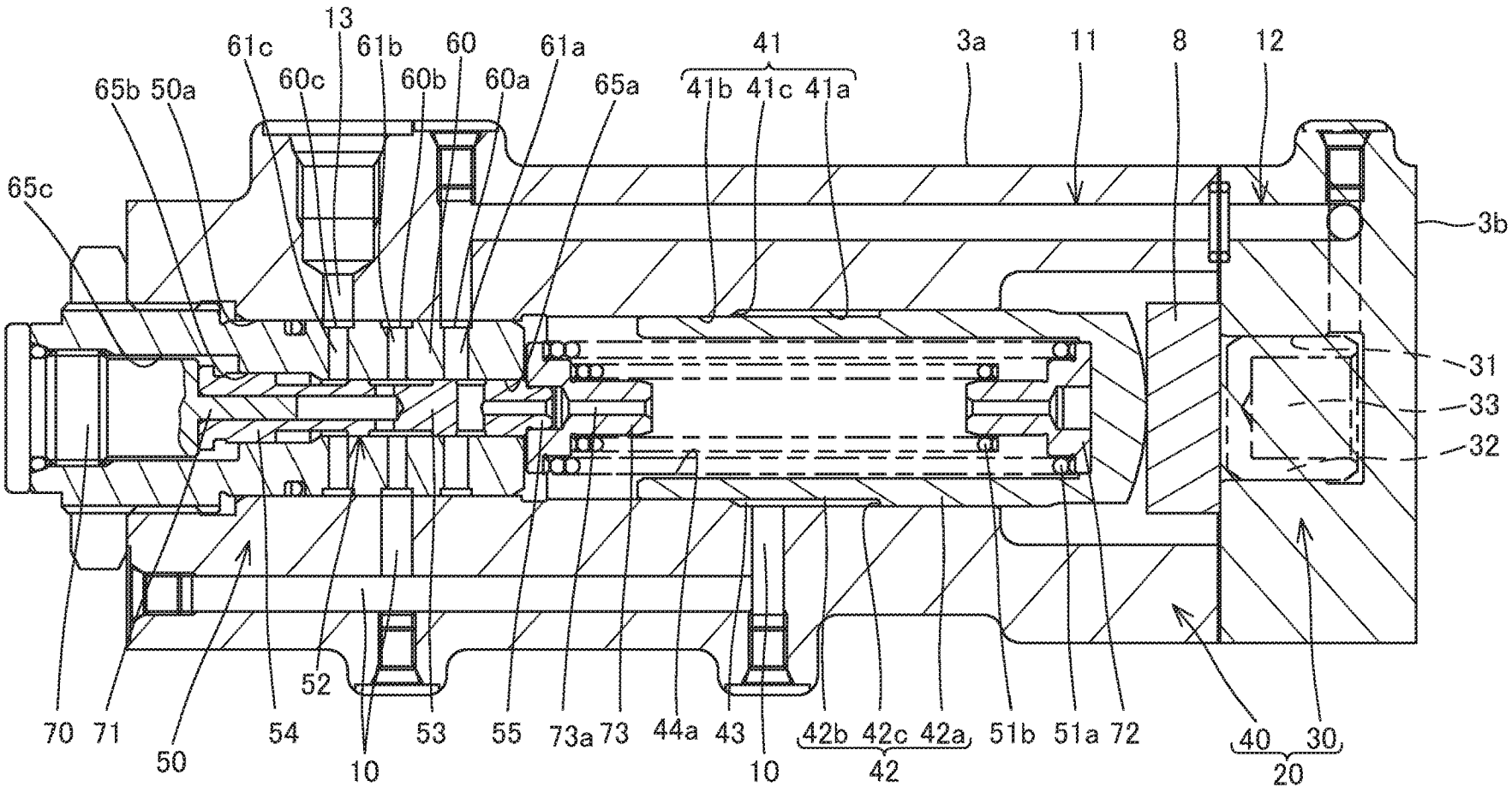
FIG. 2 is a sectional view taken along the line II-II in FIG. 1.
Figure 3:
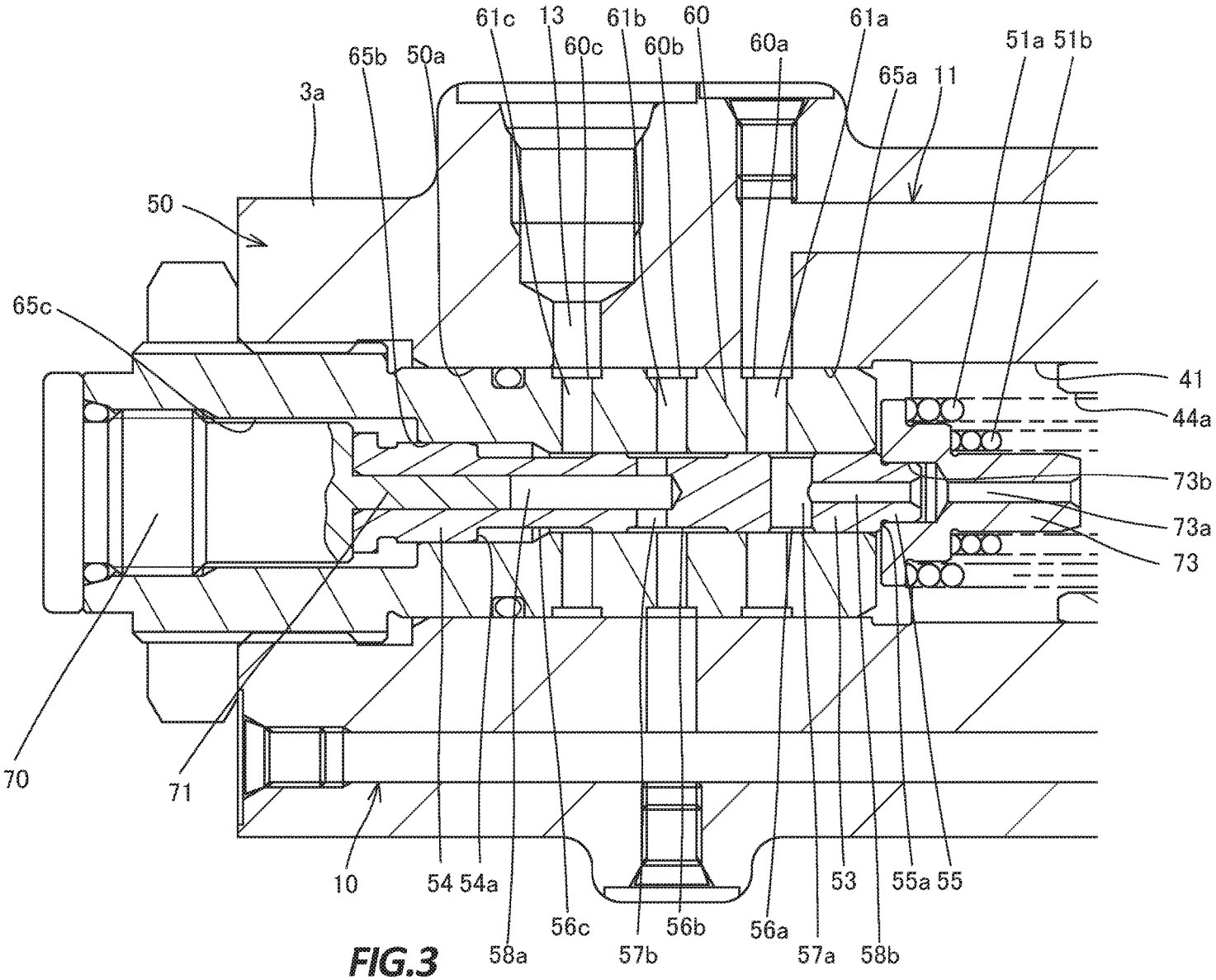
FIG. 3 is an enlarged sectional view showing a configuration of a regulator of the hydraulic rotating machine according to the embodiment of the present invention.

As shown in FIGS. 1 to 3, the piston pump 100 further includes a tilting mechanism 20 configured to tilt the swash plate 8 in accordance with fluid pressure, and a regulator 50 configured to control the fluid pressure led to the tilting mechanism 20 in accordance with a tilting angle of the swash plate 8.

The tilting mechanism 20 has a first biasing mechanism 30 configured to bias the swash plate 8 in the direction in which the tilting angle is decreased, and a second biasing mechanism 40 configured to bias the swash plate 8 in the direction in which the tilting angle is increased. That is, the second biasing mechanism 40 biases the swash plate 8 against the first biasing mechanism 30.

As shown in FIG. 1, the first biasing mechanism 30 has a large diameter piston 32 serving as a drive piston configured to be slidably inserted into a first piston accommodation hole 31 formed in the cover 3*b* and abutted with the swash plate 8, and a control pressure chamber 33 partitioned in the first piston accommodation hole 31 by the large diameter piston 32.

Fluid pressure adjusted by the regulator 50 (hereinafter, called as the "control pressure") is led to the control pressure chamber 33. The large diameter piston 32 biases the swash plate 8 by the control pressure led to the control pressure chamber 33 in the direction in which the tilting angle is decreased.

The second biasing mechanism 40 has a small diameter piston 42 serving as a control piston configured to be slidably inserted into a second piston accommodation hole 41 formed in the case main body 3*a* and abutted with the swash plate 8, and a pressure chamber 43 partitioned in the second piston accommodation hole 41 by the small diameter piston 42.

As shown in FIG. 2, the small diameter piston 42 has a first sliding portion 42*a*, a second sliding portion 42*b* having an outer diameter smaller than that of the first sliding portion 42*a*, and a level difference surface 42*c* formed by an outer diameter difference between the first sliding portion 42*a* and the second sliding portion 42*b*.

The second piston accommodation hole 41 has a first accommodation portion 41*a* on which the first sliding portion 42*a* of the small diameter piston 42 slides, a second accommodation portion 41*b* having an inner diameter smaller than that of the first accommodation portion 41*a*, the second accommodation portion 41*b* on which the second sliding portion 42*b* slides, and a level difference surface 41*c* formed by an inner diameter difference between the first accommodation portion 41*a* and the second accommodation portion 41*b*. The first accommodation portion 41*a* is open inside the case 3. The pressure chamber 43 is partitioned by an outer peripheral surface of the second sliding portion 42*b* and the level difference surface 42*c* of the small diameter piston 42, and an inner peripheral surface of the first accommodation portion 41*a* and the level difference surface 41*c* of the second piston accommodation hole 41. That is, the pressure chamber 43 is an annular space formed in an outer periphery of the small diameter piston 42.

Discharge pressure (self-pressure) of the piston pump 100 is always led to the pressure chamber 43 through a discharge pressure passage 10 formed in the case main body 3*a*. The small diameter piston 42 receives the discharge pressure led to the pressure chamber 43 and biases the swash plate 8 in the direction in which the tilting angle is increased. The level difference surface 42*c* formed in the outer periphery of the small diameter piston 42 is a pressure receiving surface of the small diameter piston 42 configured to receive the discharge pressure led to the pressure chamber 43.

A spring accommodation hole (accommodation hole) 44*a* in which one end portions of an outside spring 51*a* and inside spring 51*b* to be described later are accommodated is formed in an end portion of the small diameter piston 42 on the opposite side of the swash plate 8. Further, a communication hole 44*b* providing communication between the spring accommodation hole 44*a* and the inside of the case 3 is formed in the small diameter piston 42 (see FIG. 1). Therefore, the inside of the spring accommodation hole 44*a* and the second piston accommodation hole 41 communicates with the tank through the communication hole 44*b*.

The large diameter piston 32 is formed so that a pressure receiving area of the control pressure is larger than that of the small diameter piston 42. As shown in FIG. 1, the large diameter piston 32 is provided on the opposite side of the small diameter piston 42 with respect to the swash plate 8. That is, the large diameter piston 32 is arranged so that a circumferential position with respect to the center axis of the shaft 1 substantially matches with the small diameter piston 42.

The regulator 50 adjusts the control pressure led to the control pressure chamber 33 in accordance with the discharge pressure of the piston pump 100, and controls horsepower (output) of the piston pump 100. The regulator 50 is not limited to the configuration in the present embodiment but known configurations can be adopted.

The regulator 50 has the outside spring 51*a* and the inside spring 51*b* serving as biasing members configured to bias the small diameter piston 42 toward the swash plate 8, a control spool 52 configured to be moved in accordance with biasing force of the outside spring 51*a* and the inside spring 51*b*, the control spool being configured to adjust the control pressure, a sleeve 60 having a spool accommodation hole 65 in which the control spool 52 is accommodated, the sleeve being attached to an attachment hole 67 formed in the case main body 3*a*, a plug 70 sealing the spool accommodation hole 65 in the sleeve 60, and a shaft portion 71 provided in the plug 70 and inserted into the control spool 52.

The outside spring 51*a* and the inside spring 51*b* are coil springs, respectively. The inside spring 51*b* has a winding diameter smaller than that of the outside spring 51*a*, and is provided inside the outside spring 51*a*. The one end portions of the outside spring 51*a* and the inside spring 51*b* are accommodated in the spring accommodation hole 44*a* of the small diameter piston 42, and seated in a bottom portion of the spring accommodation hole 44*a* via a spring seat 72. The other end portions of the outside spring 51*a* and the inside spring 51*b* are seated in an end surface of the control spool 52 via a spring seat 73. The spring seat 72 on one side is moved together with the small diameter piston 42, and the spring seat 73 on the other side is moved together with the control spool 52.

Natural length (free length) of the outside spring 51*a* is longer than natural length of the inside spring 51*b*. In a state where the tilting angle of the swash plate 8 is maximum (state shown in FIG. 1), the outside spring 51*a* is compressed by the spring seat 72 while any end portion of the inside spring 51*b* is separated from and floated on the spring seat (spring seat 72 in FIG. 1) (to have the natural length). That is, when the tilting angle of the swash plate 8 is decreased from the maximum state, only the outside spring 51*a* is compressed at the beginning. When the outside spring 51*a* is compressed so that the length of the outside spring 51*a* exceeds the natural length of the inside spring 51*b*, both the outside spring 51*a* and the inside spring 51*b* are compressed. Thereby, elastic force from the outside spring 51*a* and the inside spring 51*b* applied to the swash plate 8 via the small diameter piston 42 is configured to be enhanced stepwise.

The attachment hole 67 to which the sleeve 60 is attached is formed coaxially with the second piston accommodation hole 41 in which the small diameter piston 42 is accommodated, and provided to communicate with the second piston accommodation hole 41.

The control spool 52 is slidably inserted into the spool accommodation hole 65 of the sleeve 60. As shown in FIGS. 2 and 3, the spool accommodation hole 65 has a first hole portion 65*a*, a second hole portion 65*b* having an inner diameter larger than that of the first hole portion 65*a*, and a third hole portion 65*c* having an inner diameter larger than that of the second hole portion 65*b*. The first hole portion 65*a* is open in the second piston accommodation hole 41 in which the small diameter piston 42 is accommodated. The third hole portion 65*c* is sealed by the plug 70.

In an outer periphery of the sleeve 60, a first port 60*a*, a second port 60*b*, and a third port 60*c* are formed respectively as annular grooves. In the sleeve 60, a first communication hole 61*a*, a second communication hole 61*b*, and a third communication hole 61*c* respectively communicating with the first port 60*a*, the second port 60*b*, and the third port 60*c* are formed respectively as through holes extending in the radial direction and passing through the spool accommodation hole 65. The first communication hole 61*a*, the second communication hole 61*b*, and the third communication hole 61*c* are respectively open in the first hole portion 65*a* of the spool accommodation hole 65.

The first port 60*a* is formed in the case main body 3*a* and communicates with a control pressure passage 11 through which the control pressure is led to the control pressure chamber 33 of the large diameter piston 32. The control pressure passage 11 communicates with the control pressure chamber 33 through a cover side passage 12 formed in the cover 3*b*. The second port 60*b* communicates with the discharge pressure passage 10 to which the discharge pressure of the piston pump 100 is led. The third port 60*c* communicates with an external pressure passage 13 to which pump oil pressure discharged from another pump configured to be driven by the power source together with the piston pump 100 (hereinafter, called as the "external pump pressure") is led. The discharge pressure of the piston pump 100 is always led to the discharge pressure passage 10. By control of supply/shut-off of the external pump pressure to the external pressure passage 13 and adjustment of the magnitude of the external pump pressure led to the external pressure passage 13, it is possible to adjust a control characteristic of the tilting angle of the swash plate 8 (in other words, a horsepower control characteristic) with respect to a change in a load of the piston pump 100.

As shown in FIG. 3, the control spool 52 has a main body portion 53 configured to slide on the first hole portion 65*a* of the spool accommodation hole 65, a large diameter portion 54 provided in one end portion of the main body portion 53 and formed to have an outer diameter larger than that of the main body portion 53, and a projecting portion 55 provided in the other end portion on the opposite side of the large diameter portion 54 and configured to be inserted into the spring seat 73. The large diameter portion 54 slides on the second hole portion 65*b* of the spool accommodation hole 65, and forms a level difference surface 54*a* by an outer diameter difference from the main body portion 53. The projecting portion 55 is formed to have an outer diameter smaller than that of the main body portion 53. A level difference surface 55*a* generated by an outer diameter difference between the main body portion 53 and the projecting portion 55 is abutted with the spring seat 73.

In an outer periphery of the control spool 52, a first control port 56*a*, a second control port 56*b*, and a third control port 56*c* are formed respectively as annular grooves. In the control spool 52, a first control passage 57*a* and a second control passage 57*b* respectively communicating with the first control port 56*a* and the second control port 56*b* are respectively formed to pass through the control spool 52 in the radial direction.

In the control spool 52, a shaft portion insertion hole 58*a* formed from an end portion on the plug 70 side, the shaft portion insertion hole 58*a* into which the shaft portion 71 provided in the plug 70 is inserted, and an axial direction passage 58*b* providing communication between a connection passage 73*a* which is formed in the spring seat 73 and communicates with the spring accommodation hole 44*a* (second piston accommodation hole 41) and the first control passage 57*a* are further formed.

The shaft portion insertion hole 58*a* communicates with the second control passage 57*b*, and the shaft portion 71 is inserted into the shaft portion insertion hole 58*a* slidably with respect to the control spool 52. Therefore, the discharge pressure led to the second control passage 57*b* acts on an inner wall portion of the second control passage 57*b* opposing the shaft portion 71 in the control spool 52. The control spool 52 receives the discharge pressure by a pressure receiving area corresponding to an amount of a sectional area of the shaft portion 71 (shaft portion insertion hole 58*a*), and is biased in the direction in which the outside spring 51*a* and the inside spring 51*b* are compressed by the discharge pressure.

As shown in FIGS. 1 and 3, the first control passage 57*a* communicates with the inside of the case 3 through the axial direction passage 58*b*, the connection passage 73*a* of the spring seat 73, and the spring accommodation hole 44*a* and the communication hole 44*b* of the small diameter piston 42. Therefore, pressure in the first control passage 57*a* is tank pressure.

The external pump pressure is led to the third control port 56*c* of the control spool 52 through the third port 60*c* and the third communication hole 61*c* of the sleeve 60. The external pump pressure led to the third control port 56*c* acts on the level difference surface 54*a* between the main body portion 53 and the large diameter portion 54 in the control spool 52 (see FIG. 3). Thereby, the control spool 52 is biased by the external pump pressure in the direction in which the outside spring 51*a* and the inside spring 51*b* are extended, in other words, in the direction in which the control spool 52 is separated from the swash plate 8.

In this way, the control spool 52 is biased in the direction in which the control spool 52 is separated from the swash plate 8 (to the left side in the figures) by the biasing force by the outside spring 51*a* and the inside spring 51*b* and biasing force by the external pump pressure. The control spool 52 is also biased in the direction in which the control spool 52 is brought close to the swash plate 8 by the discharge pressure. The control spool 52 is moved so that the biasing force by the outside spring 51*a* and the inside spring 51*b*, the biasing force by the external pump pressure, and biasing force of the discharge pressure are balanced.

Specifically, the control spool 52 is moved between two positions of a first position and a second position. FIGS. 1 to 3 show a state where the control spool 52 is placed at the second position. Following movement to the right side in the figures from the second position shown in FIGS. 1 to 3, the control spool 52 is switched to the first position.

The first position is a position where the tilting angle of the swash plate 8 is decreased and a discharge capacity of the piston pump 100 is reduced. At the first position, the first communication hole 61*a* and the second communication hole 61*b* of the sleeve 60 communicate with each other through the second control port 56*b* of the control spool 52, and communication between the first control passage 57*a* of the control spool 52 and the first communication hole 61*a* is shut off. Therefore, at the first position, the discharge pressure of the piston pump 100 is led to the control pressure chamber 33 of the first biasing mechanism 30.

The second position is a position where the tilting angle of the swash plate 8 is increased and the discharge capacity of the piston pump 100 is increased. At the second position, the first communication hole 61*a* and the first control passage 57*a* of the control spool 52 communicate with each other through the first control port 56*a*, and communication between the first communication hole 61*a* and the second communication hole 61*b* is shut off. Therefore, at the second position, the tank pressure is led to the control pressure chamber 33.

In the regulator 50, when the position is switched between the first position and the second position, the first communication hole 61*a* of the sleeve 60 communicates with both the second communication hole 61*b* of the sleeve 60 and the first control passage 57*a* of the control spool 52. In other words, in the regulator 50, when the position is switched between the first position and the second position, communication between the first communication hole 61*a* and other passages is not shut off so that pressure of the first communication hole 61*a* (control pressure chamber 33) is not locked in.

Next, operations of the piston pump 100 will be described.

In the piston pump 100, the horsepower control of controlling the discharge capacity of the piston pump 100 (tilting angle of the swash plate 8) is performed so that the discharge pressure of the piston pump 100 is maintained to be fixed by the regulator 50.

The control spool 52 of the regulator 50 is biased to be placed at the first position by the biasing force by the discharge pressure of the piston pump 100, and also biased to be placed at the second position by the biasing force of the outside spring 51*a* and the inside spring 51*b* and the biasing force by the external pump pressure of another pump.

In a state where the biasing force by the discharge pressure of the piston pump 100 is maintained to be not more than the biasing force of the outside spring 51*a* and the biasing force of the external pump pressure, the control spool 52 of the regulator 50 is placed at the second position, and the tilting angle of the swash plate 8 is maintained to be maximum.

The discharge pressure of the piston pump 100 is increased following an increase in a load of the hydraulic cylinder configured to be driven by the discharge pressure of the piston pump 100. When the discharge pressure of the piston pump 100 is increased from a state where the tilting angle of the swash plate 8 is maintained to be maximum, the biasing force by the discharge pressure becomes more than the total force of the biasing force by the outside spring 51*a* and the biasing force by the external pump pressure. Thereby, the control spool 52 is moved in the direction in which the control spool 52 is switched from the second position to the first position (to the right side in the figures). When the control spool 52 is moved to the first position, the discharge pressure is led to the control pressure passage 11, and hence, the control pressure is increased. More specifically, as the control spool 52 is moved to the first position, an opening area (flow passage area) of the second control port 56*b* of the control spool 52 with respect to the first communication hole 61*a* of the sleeve 60 is increased. Therefore, as a moving amount of the control spool 52 in the direction in which the control spool 52 is switched to the first position (to the right side in the figures) is increased, the control pressure led to the control pressure passage 11 is increased. Since the control pressure led to the control pressure passage 11 is increased, the large diameter piston 32 is moved toward the swash plate 8, and the swash plate 8 is tilted in the direction in which the tilting angle is decreased. Therefore, the discharge capacity of the piston pump 100 is reduced.

When the swash plate 8 is tilted in the direction in which the tilting angle is decreased, the small diameter piston 42 is moved to the left side in the figures following the swash plate 8 so that the outside spring 51*a* and the inside spring 51*b* are compressed. In other words, when the swash plate 8 is tilted in the direction in which the tilting angle is decreased, the small diameter piston 42 is moved to bias the control spool 52 through the outside spring 51*a* (and the inside spring 51*b*) in the direction in which the control spool 52 is switched to the second position. When the control spool 52 is thereby pushed back and moved in the direction in which the control spool 52 is switched to the second position, the control pressure supplied to the control pressure chamber 33 through the control pressure passage 11 is reduced. When biasing force applied to the swash plate 8 by the control pressure is balanced with the biasing force applied to the swash plate 8 from the outside spring 51*a* (and the inside spring 51*b*) following reduction in the control pressure, movement of the large diameter piston 32 (tilt of the swash plate 8) is stopped. In this way, when the discharge pressure of the piston pump 100 is increased, the discharge capacity is reduced.

On the contrary, the discharge pressure of the piston pump 100 is lowered following a decrease in the load of the hydraulic cylinder configured to be driven by the discharge pressure of the piston pump 100. When the discharge pressure of the piston pump 100 is lowered, the biasing force by the discharge pressure of the piston pump 100 becomes lower than the total force of the biasing force by the outside spring 51*a* and the inside spring 51*b* and the biasing force by the external pump pressure. Thereby, the control spool 52 is moved in the direction in which the control spool 52 is switched from the first position to the second position. When the control spool 52 is moved to the second position, the control pressure passage 11 communicates with the first control passage 57*a* of the tank pressure, and hence the control pressure is lowered. Since the control pressure is lowered, the swash plate 8 is tilted in the direction in which the tilting angle is increased by the small diameter piston 42 receiving the biasing force of the outside spring 51*a* and the inside spring 51*b* and the biasing force by the external pump pressure.

When the swash plate 8 is tilted in the direction in which the tilting angle is increased, the small diameter piston 42 receiving the biasing force of the outside spring 51*a* and the inside spring 51*b* is moved to the right side in the figures following the swash plate 8 so that the outside spring 51*a* and the inside spring 51*b* are extended. Thereby, the biasing force received from the outside spring 51*a* and the inside spring 51*b* by the control spool 52 is decreased. Therefore, the control spool 52 receives the discharge pressure led to the second control passage 57*b* and is moved in the direction in which the outside spring 51*a* and the inside spring 51*b* are compressed. That is, the control spool 52 is moved in the direction in which the control spool 52 is switched from the second position to the first position to follow the small diameter piston 42. When the control spool 52 is placed at the first position again, the control pressure is increased, and the biasing force applied to the swash plate 8 by the control pressure is balanced with the biasing force applied to the swash plate 8 from the outside spring 51*a* (and the inside spring 51*b*), the movement of the large diameter piston 32 (tilt of the swash plate 8) is stopped. In this way, when the discharge pressure of the piston pump 100 is lowered, the discharge capacity is increased.

As described above, the horsepower control is performed so that the discharge capacity of the piston pump 100 is reduced by increasing the discharge pressure of the piston pump 100, and the discharge capacity is increased by lowering the discharge pressure.

According to the embodiment described above, the following effects are exerted.

In the piston pump 100, the small diameter piston 42 receives thrust force by the discharge pressure led to the pressure chamber 43 and also receives the biasing force of the outside spring 51*a* and the inside spring 51*b* of the regulator 50, and follows the tilt of the swash plate 8. That is, the small diameter piston 42 exerts a function of controlling the tilting angle of the swash plate 8 (driving the swash plate 8), and in addition, a function of detecting the tilting angle of the swash plate 8 in order to adjust the control pressure by the regulator 50. Therefore, there is no need for providing a pin configured to detect the tilting angle separately from the small diameter piston 42 unlike a conventional piston pump 100, and it is possible to downsize the piston pump 100.

In the piston pump 100, the outside spring 51*a* and the inside spring 51*b* are accommodated in the spring accommodation hole 44*a* formed in the small diameter piston 42. That is, the outside spring 51*a* and the inside spring 51*b* are not provided in series and placed side by side in the axial direction with respect to the small diameter piston 42 but provided inside the small diameter piston 42. Thereby, in comparison to a case where the outside spring 51*a* and the inside spring 51*b* and the small diameter piston 42 are placed side by side in the axial direction, it is possible to save spaces and it is possible to further downsize the piston pump 100.

In the piston pump 100, the large diameter piston 32 is arranged on the opposite side of the small diameter piston 42 with respect to the swash plate 8 so that the circumferential position with respect to the center axis of the shaft 1 substantially matches with the small diameter piston 42. Thereby, it is possible to prevent an increase in size of the swash plate 8 in the radial direction of the shaft 1, and thus, it is possible to downsize the piston pump 100.

Next, modified examples of the above embodiment will be described. The following modified examples are also included within the range of the present invention, and it is also possible to combine the following modified examples and each of the configurations of the above embodiment or to combine the following modified examples with each other.

In the above embodiment, the small diameter piston 42 is provided in the second piston accommodation hole 41 formed in the case main body 3*a*, and the large diameter piston 32 is provided in the first piston accommodation hole 31 formed in the cover 3*b*. Meanwhile, the small diameter piston 42 is not limited to the configuration in which the small diameter piston 42 is provided in the case main body 3*a*. The large diameter piston 32 is not limited to the configuration in which the large diameter piston 32 is provided in the cover 3*b*. For example, the second piston accommodation hole 41 may be formed in a member formed as a body separate from the case main body 3*a* and attached to the case main body 3*a*, and the small diameter piston 42 may be provided in the second piston accommodation hole 41. Similarly, the first piston accommodation hole 31 may be formed in a member formed as a body separate from the cover 3*b* and attached to the cover 3*b*, and the large diameter piston 32 may be provided in the first piston accommodation hole 31. As the piston pump, unlike the configuration in which the swash plate 8 is supported by the cover 3*b* as in the above embodiment, there is also a piston pump of a mode in which a swash plate 8 is supported on the bottom portion side of a case main body 3*a*. In such a case, the small diameter piston 42 and the large diameter piston 32 may be respectively provided in accommodation holes (of the first piston accommodation hole 31 and the second piston accommodation hole 41) formed in the case main body 3*a*. At least, as long as the small diameter piston 42 and the large diameter piston 32 are arranged to oppose each other across the swash plate 8 so that the circumferential positions with respect to the center axis of the shaft 1 substantially match with each other, it is possible to exert an effect that the piston pump 100 can be downsized.

In the above embodiment, the case where the hydraulic rotating machine 100 is the piston pump is described. In a case where the hydraulic rotating machine 100 functions as the piston motor, supply pressure supplied to the piston motor may serve as self-pressure and may be led to a pressure chamber 43. In this way, the self-pressure indicates relatively high fluid pressure among fluid pressure supplied to and discharged from the hydraulic rotating machine 100.

Hereinafter, the configurations, the operations, and the effects of the embodiment of the present invention will be summed up and described.

The piston pump 100 includes the cylinder block 2 configured to be rotated following the rotation of the shaft 1, the plural cylinders 2*b* formed in the cylinder block 2 and arranged at predetermined intervals in the circumferential direction of the shaft 1, the pistons 5 slidably inserted into the cylinders 2*b* and configured to partition the capacity chambers 6 inside the cylinders 2*b*, the swash plate 8 configured to let the pistons 5 reciprocate so that the capacity chambers 6 are expanded and contracted following the rotation of the cylinder block 2, the first biasing mechanism 30 configured to bias the swash plate 8 in accordance with the supplied control pressure, the second biasing mechanism 40 configured to bias the swash plate 8 against the first biasing mechanism 30, and the regulator 50 configured to control the control pressure led to the first biasing mechanism 30 in accordance with the discharge pressure of the piston pump 100. The second biasing mechanism 40 has the pressure chamber 43 to which the discharge pressure is led, and the small diameter piston 42 configured to be biased toward the swash plate 8 by the discharge pressure led to the pressure chamber 43. The regulator 50 has the biasing members (of the outside spring 51*a* and the inside spring 51*b*) configured to bias the small diameter piston 42 toward the swash plate 8, and the control spool 52 configured to be moved in accordance with the biasing force of the biasing members (of the outside spring 51*a* and the inside spring 51*b*), the control spool being configured to adjust the control pressure.

With this configuration, the small diameter piston 42 receives the pressure of the pressure chamber 43 and drives the swash plate 8, and is biased toward the swash plate 8 by the biasing members (of the outside spring 51*a* and the inside spring 51*b*) of the regulator 50 and displaced following the swash plate 8 in accordance with the tilt of the swash plate 8. Therefore, when the small diameter piston 42 is displaced, the biasing force of the biasing members (of the outside spring 51*a* and the inside spring 51*b*) is changed and the control spool 52 is also displaced. In this way, the small diameter piston 42 exerts the function of controlling the tilting angle of the swash plate 8, and in addition, the function of detecting the tilting angle of the swash plate 8 in order to adjust the control pressure by the regulator 50. Thus, there is no need for providing a pin configured to detect the tilting angle separately from the small diameter piston 42. Therefore, it is possible to downsize the piston pump 100.

In the piston pump 100, the spring accommodation hole 44*a* in which the biasing members (of the outside spring 51*a* and the inside spring 51*b*) are accommodated is formed in the small diameter piston 42.

With this configuration, the biasing members (of the outside spring 51*a* and the inside spring 51*b*) are not provided in series and placed side by side in the axial direction with respect to the small diameter piston 42 but provided inside the small diameter piston 42. Thereby, in comparison to a case where the biasing members (of the outside spring 51*a* and the inside spring 51*b*) and the small diameter piston 42 are placed side by side in the axial direction, it is possible to save spaces and it is possible to further downsize the piston pump 100.

In the piston pump 100, the level difference surface 42*c* configured to receive the discharge pressure led to the pressure chamber 43 is formed in the outer periphery of the small diameter piston 42.

In the piston pump 100, the first biasing mechanism 30 has the control pressure chamber 33 to which the control pressure is led, and the large diameter piston 32 provided on the opposite side of the small diameter piston 42 with respect to the swash plate 8 so that the circumferential position with respect to the shaft 1 matches with the small diameter piston 42, the large diameter piston 32 being configured to bias the swash plate 8 against the small diameter piston 42 by the control pressure led to the control pressure chamber 33.

With this configuration, the large diameter piston 32 is arranged so that the circumferential position with respect to the center axis of the shaft 1 substantially matches with the small diameter piston 42. Thereby, it is possible to prevent the increase in the size of the swash plate 8 in the radial direction of the shaft 1, and it is possible to downsize the piston pump 100.

Embodiments of the present invention were described above, but the above embodiments are merely examples of applications of the present invention, and the technical scope of the present invention is not limited to the specific constitutions of the above embodiments.

With respect to the above description, the contents of application No. 2018-183678, with a filing date of Sep. 28, 2018 in Japan, are incorporated herein by reference.

The invention claimed is:

1. A hydraulic rotating machine, comprising:

a cylinder block configured to be rotated following rotation of a drive shaft;

plural cylinders formed in the cylinder block and arranged at predetermined intervals in the circumferential direction of the drive shaft;

pistons slidably inserted into the cylinders and configured to partition capacity chambers inside the cylinders;

a swash plate configured to let the pistons reciprocate so that the capacity chambers are expanded and contracted following rotation of the cylinder block;

a first biasing mechanism configured to bias the swash plate in accordance with supplied control pressure;

a second biasing mechanism configured to bias the swash plate against the first biasing mechanism; and a regulator configured to control the control pressure led to the first biasing mechanism in accordance with self-pressure of the hydraulic rotating machine, wherein the second biasing mechanism has:

a pressure chamber to which the self-pressure is led, and a control piston configured to be biased toward the swash plate by the self-pressure led to the pressure chamber;

the regulator has:

a biasing member configured to bias the control piston toward the swash plate, and a control spool configured to be moved in accordance with biasing force of the biasing member, the control spool being configured to adjust the control pressure; and an accommodation hole in which the biasing member is accommodated is formed in the control piston.

2. The hydraulic rotating machine according to claim 1, wherein a pressure receiving surface configured to receive the self-pressure led to the pressure chamber is formed in an outer periphery of the control piston.

3. The hydraulic rotating machine according to claim 1, wherein the first biasing mechanism has:

a control pressure chamber to which the control pressure is led; and a drive piston provided on the opposite side of the control piston with respect to the swash plate so that a circumferential position with respect to the drive shaft matches with the control piston, the drive piston being configured to bias the swash plate against the control piston by the control pressure led to the control pressure chamber.

4. A fluid pressure rotating machine, comprising:

a cylinder block configured to be rotated following rotation of a drive shaft;

plural cylinders formed in the cylinder block and arranged at predetermined intervals in the circumferential direction of the drive shaft;

pistons slidably inserted into the cylinders and configured to partition capacity chambers inside the cylinders;

a swash plate configured to let the pistons reciprocate so that the capacity chambers are expanded and contracted following rotation of the cylinder block;

a first biasing mechanism configured to bias the swash plate in accordance with supplied control pressure;

a second biasing mechanism configured to bias the swash plate against the first biasing mechanism; and a regulator configured to control the control pressure led to the first biasing mechanism in accordance with self-pressure of the fluid pressure rotating machine, wherein the second biasing mechanism has:

a pressure chamber to which the self-pressure is led, and a control piston configured to be biased toward the swash plate by the self-pressure led to the pressure chamber;

the first biasing mechanism has:

a control pressure chamber to which the control pressure is led, and a drive piston provided on the opposite side of the control piston with respect to the swash plate, the drive piston being configured to bias the swash plate against the control piston by the control pressure led to the control pressure chamber;

the regulator has:

a biasing member configured to bias the control piston toward the swash plate, and a control spool configured to be moved in accordance with biasing force of the biasing member, the control spool being configured to adjust the control pressure; and an accommodation hole in which the biasing member is accommodated is formed in the control piston.

* * * * *